US008267151B2

(12) United States Patent
Chu et al.

(10) Patent No.: US 8,267,151 B2
(45) Date of Patent: Sep. 18, 2012

(54) MOLD FOR GRAVITY CASTING AND GRAVITY CASTING METHOD USING THE MOLD

(75) Inventors: Dong Ho Chu, Ansan (KR); Dong-chang Choi, Busan (KR); Jae-yong Lee, Haman-gun (KR)

(73) Assignees: Hyundai Motor Company, Seoul (KR); Kia Motors Corporation, Seoul (KR); Samshin Precision Co., Ltd., Haman-Gun (KR)

( * ) Notice: Subject to any disclaimer, the term of this patent is extended or adjusted under 35 U.S.C. 154(b) by 0 days.

(21) Appl. No.: 13/238,265

(22) Filed: Sep. 21, 2011

(65) Prior Publication Data

US 2012/0145350 A1 Jun. 14, 2012

(30) Foreign Application Priority Data

Dec. 9, 2010 (KR) ..... 10-2010-0125696

(51) Int. Cl.

| | |
|---|---|
| ***B22C 9/10*** | (2006.01) |
| ***B22C 9/22*** | (2006.01) |
| ***B22C 9/08*** | (2006.01) |

(52) U.S. Cl. ..... 164/339; 164/359; 164/369

(58) Field of Classification Search ..... 164/349–369, 164/339–341

See application file for complete search history.

(56) References Cited

FOREIGN PATENT DOCUMENTS

| | | | |
|---|---|---|---|
| JP | 2000274238 A | * | 10/2000 |
| JP | 2003221639 A | * | 8/2003 |
| KR | 2011063107 A | * | 6/2011 |

* cited by examiner

*Primary Examiner* — Kuang Lin
*Assistant Examiner* — Kevin E Yoon
(74) *Attorney, Agent, or Firm* — Morgan, Lewis & Bockius LLP

(57) ABSTRACT

A mold and method for gravity casting may integrally cast a turbine housing having a twin scroll unit and a bypass unit and an exhaust manifold having a plurality of exhaust runner units. A turbine housing-side riser may be formed based on the end portion of the twin scroll unit within a first mold and a second mold in the state where the cavity of the turbine housing is formed so that the end portion of the twin scroll unit which is the outlet of the turbine housing is upward disposed.

5 Claims, 11 Drawing Sheets

S

E

MOLD FOR GRAVITY CASTING AND GRAVITY CASTING METHOD USING THE MOLD

CROSS-REFERENCE TO RELATED APPLICATION

This application claims priority to and the benefit of Korean Patent Application No. 10-2010-0125696 filed Dec. 9, 2010, the entire contents of which application is incorporated herein for all purposes by this reference.

BACKGROUND OF INVENTION

1. Field of Invention

The present invention relates to a mold for gravity casting and a gravity casting method using the same. More particularly, the present invention relates to a mold for gravity casting and a gravity casting method using the same, in which a turbine housing having a twin scroll unit and an exhaust manifold are integrally cast.

2. Description of Related Art

In general, a gravity casting method is a casting method of solidifying injected molten metal within a cast (that is, a mold) using gravity of the molten metal and is characterized in that the cooling speed of the molten metal is fast and a crystal grain is fine.

FIG. 1 is a schematic view of a common gravity casting method. A mold applied to the conventional gravity casting method includes a cast 111 configured to have an upper cast and a lower cast, an injection port 115 configured to have molten metal of high temperature injected therein, a sprue 117 filled with the injected molten metal of high temperature, a runner 119 configured to transfer the molten metal filled into the sprue 117, a cavity 113 filled with the molten metal, transferred through the runner 119, and configured to cast a product, and a riser 121 connected to the runner 119 between the sprue 117 and the cavity 113, filled with the molten metal, and configured to provide the molten metal when the molten metal filled into the cavity 113 is cooled and thus the volume of the molten metal is reduced.

Accordingly, in the gravity casting method using the mold constructed as above, when the molten metal of high temperature is injected through the injection port 115 of the cast 111 using a ladle, the injected molten metal of high temperature is filled into the sprue 117.

The molten metal filled into the sprue 117 is flown through the runner 119 and filled into the riser 121 and the cavity 113. Next, after the molten metal is filled into the cavity 113, the molten metal within the sprue 117 is heated by a heating burner 123 so that the molten metal is not early clotted.

In order to prevent a crack from being generated in a cast product owing to a volume reduced when the molten metal filled into the cavity 113 is cooled, the molten metal filled into the riser 121 is supplied to the cavity 113 in order to supplement reduced molten metal.

The gravity casting method is particularly applied to the cast of an engine, including a cylinder head and a cylinder block in a vehicle maker, a camshaft, a crankshaft, an intake and exhaust manifold, and a turbine housing. Bodies for the components are fabricated and then produced into finished products through several processing processes.

Meanwhile, with the recent increasing use of a gasoline turbocharger, a method of integrally fabricating a twin scroll turbocharger and an exhaust manifold by optimizing the shape of an exhaust system is being in progress as part of improved durability and sealing and profits, as shown in FIG. 2.

That is, a turbine housing 201 for the twin scroll turbocharger is integrally cast with the exhaust manifold 203 consisting of four exhaust runner units 209. The turbine housing 201 includes a bypass unit 207 and a twin scroll unit 205, including one-side and the other-side scroll units 205*a* and 205*b*, all of which are formed of an internal space portion of the bypass unit 207.

In the conventional mold for gravity casting for integrally casting the exhaust manifold 203 and the turbine housing 201 into one body, as shown in FIG. 3, the cavity C1 of the exhaust manifold 203 and the cavity C2 of the turbine housing 201 are formed within the mold, and risers H1 and H2 respectively connected to the cavity C1 of the exhaust manifold 203 and the cavity C2 of the turbine housing 201 are also formed.

Furthermore, a plurality of gates G is formed through a gate core such that a runner R, connecting the cavity C1 of the exhaust manifold 203 and the cavity C2 of the turbine housing 201 together, is formed within the mold.

In the mold, exhaust runner cores 211, forming the respective exhaust runner units 209 of the exhaust manifold 203, are formed within the cavity C1 of the exhaust manifold 203. A twin scroll unit core and a bypass unit core, respectively forming the twin scroll unit 205 and the bypass unit 207 formed of the internal space portion of the turbine housing 201, are formed within the cavity C2 of the turbine housing 201.

Meanwhile, the twin scroll unit core has a characteristic in that the cross section thereof is reduced. Accordingly, coating is applied to a face where each scroll unit is formed in order to prevent surface adherence when cast is performed.

In order to cast the exhaust manifold 203 having the turbine housing 201 integrated therewith using the conventional mold for gravity casting, as shown in FIG. 3, molten metal of high temperature is injected through a sprue S at the top of the combined mold.

The molten metal is supplied to the underlying runner R through the sprue S and then filled into the cavity C2 of the turbine housing 201 and the cavity C1 of the exhaust manifold 203. Next, the riser H1 on the exhaust manifold side and the riser H2 on the turbine housing side are filled with the molten metal.

Here, the molten metal supplied to the cavity C2 of the turbine housing 201 is uniformly filled into the twin scroll unit 205 and the bypass unit 207 within the complex cavity C2 of the turbine housing 201 through the gates G of the gate core from the runner R. In the process of the twin scroll unit 205 being filled with the molten metal, the other-side scroll unit 205*b* on the lower side of FIG. 3 is first filled, and the one-side scroll unit 205*a* on the upper side of FIG. 3 is then filled.

Furthermore, in the state where both the cavity C2 of the turbine housing 201 and the cavity C1 of the exhaust manifold 203 within the mold are filled with the molten metal, if the molten metal is contracted in a cooling process, pressurized molten metal filled into the turbine housing-side riser H2 and the exhaust manifold-side riser H1 is supplied to supplement the contraction amount of the molten metal.

In the conventional mold for gravity casting and the conventional gravity casting method, however, the cast is formed such that the turbine housing integration type exhaust manifold is cast in a vertical direction within the cast.

In other words, in the cast, the exhaust runner units 209 of the exhaust manifold 203 are disposed up and down and then connected to the exhaust manifold-side riser H1 on the vertical side. Furthermore, the twin scroll unit 205 of the turbine housing 201 has the scroll units 205*a* and 205*b* on one side and on the other side are disposed up and down, so that the position of the turbine housing-side riser H2 corresponds to the one-side scroll units 205*a* on the upper side.

In characteristics in the cast direction of the conventional turbine housing integration type exhaust manifold, in the case where the turbine housing integration type exhaust manifold is cast using the conventional mold for gravity casting, when the molten metal of high temperature comes in contact with the faces where the scroll units of the twin scroll unit core having coasting applied thereto are formed, the coasting is evaporated, thereby generating gas.

The gas must be moved from a portion where the cross section of the twin scroll unit 205 is small to a portion where the cross section of the twin scroll unit 205 and exhausted. However, there are disadvantages in that the exhaust is not free because the cavity C2 of the turbine housing 201 is narrow and thus defects or a contraction hole are generated in the surface of a product because the molten metal and the gas are mixed.

That is, from a solidification analysis result of FIG. 4, it can be seen that residual stress is generated near the end portion A of the twin scroll unit 205 having the narrow cross section and thus a contraction hole is internally generated.

The above information disclosed in this Background section is only for enhancement of understanding of the background of the invention and therefore it may contain information that does not form the prior art that is already known in this country to a person of ordinary skill in the art.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a mold for gravity casting and a gravity casting method using the same having an advantage of the smooth exhaust of an evaporation gas generated from coating, by disposing the end portion of a twin scroll unit (that is, the outlet of a turbine housing) so that the end portion is upward disposed in the direction in which a turbine housing integration type exhaust manifold is cast within a cast and by disposing a rider on the turbine housing side at the center of a position where the twin scroll unit has a minimum cross section.

Various aspects of the present invention provide for a mold for gravity casting for integrally gravity-casting a turbine housing having a twin scroll unit and a bypass unit and an exhaust manifold having a plurality of exhaust runner units, comprising a first mold; a second mold combined with the first mold configured to form the cavity of the turbine housing so that the end portion of the twin scroll unit is upward disposed on the lower inner side between the first mold and the second mold; an exhaust runner mold disposed on the upper side between the first mold and the second mold, configured to form the cavity of the exhaust manifold connected to the cavity of the turbine housing so that the exhaust runner units are disposed in parallel in the width direction between the first mold and the exhaust runner mold and also to connect to an exhaust manifold-side riser over the cavity of the exhaust manifold, and configured to form a sprue along with an injection port for injecting molten metal into the cavity of the turbine housing between the second mold and the exhaust runner mold and also to form a turbine housing-side riser based on the end portion of the twin scroll unit; a twin scroll mold installed between the first mold and the second mold so that the twin scroll mold forms a lower portion of the cavity of the turbine housing; a twin scroll auxiliary mold installed between the first mold and the twin scroll mold and between the exhaust runner mold and the twin scroll mold so that the twin scroll auxiliary mold forms one side of the cavity of the turbine housing; a core support mold installed between the first mold and the second mold on the other side of the cavity of the turbine housing; a gate core disposed in the core support mold between the first mold and the second mold and configured to form a plurality of gates connecting the sprue and the cavity of the turbine housing; exhaust runner cores disposed within the cavity of the exhaust manifold between the first mold and the exhaust runner mold and configured to form the exhaust runner units of the exhaust manifold; and a twin scroll unit core and a bypass unit core disposed within the cavity of the turbine housing between the first mold and the second mold and configured to form the twin scroll unit and the bypass unit, respectively, formed of an internal space portion of the turbine housing.

The turbine housing-side riser may be formed to simultaneously connect end portions of scroll units of the twin scroll unit.

Furthermore, the diameter of the turbine housing-side riser may be set in the range of 1.3 to 1.8 times greater than the diameter of the injection port.

Furthermore, the exhaust runner cores may be integrally formed with the twin scroll unit core.

Furthermore, the exhaust runner cores and the twin scroll unit core may be formed by integrally connecting the two exhaust runner cores, respectively forming first and fourth of the four exhaust runner units, and a scroll unit core forming the scroll unit on one side, from the twin scroll unit and by integrally connecting the two exhaust runner cores, respectively forming second and third of the four exhaust runner units, and a scroll unit core forming the scroll unit on the other side, from the twin scroll unit.

Furthermore, a gravity casting method for integrally gravity-casting a turbine housing having a twin scroll unit and a bypass unit and an exhaust manifold having a plurality of exhaust runner units using the mold for gravity casting comprises forming a turbine housing-side riser based on the end portion of the twin scroll unit within a first mold and a second mold in the state where the cavity of the turbine housing is formed so that the end portion of the twin scroll unit which is the outlet of the turbine housing is upward disposed.

The turbine housing-side riser may be gravity-cast so that end portions of scroll units of the twin scroll unit are simultaneously connected together.

As described above, in accordance with the mold for gravity casting and the gravity casting method using the same according to various aspects of the present invention, in the direction in which the turbine housing integration type exhaust manifold is cast within the cast through the separate exhaust runner mold between the first mold and the second mold, the end portion of a twin scroll unit (that is, the outlet of a turbine housing) is disposed so that the end portion is upward disposed, and the rider on the turbine housing side is disposed at the center of a position where the twin scroll unit has a minimum cross section. Accordingly, an evaporation gas generated from coating can be smoothly exhausted.

Furthermore, although a separate gas exhaust hole connected to the cavity of the twin scroll unit of the turbine housing is not formed, an evaporation gas generated from coasting owing to molten metal is not mixed with the molten metal. Accordingly, a surface adherence phenomenon can be prevented, and residual stress is not generated near the end portion of the twin scroll unit having a narrow cross section. Consequently, product defects, such as contraction holes, can be prevented.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
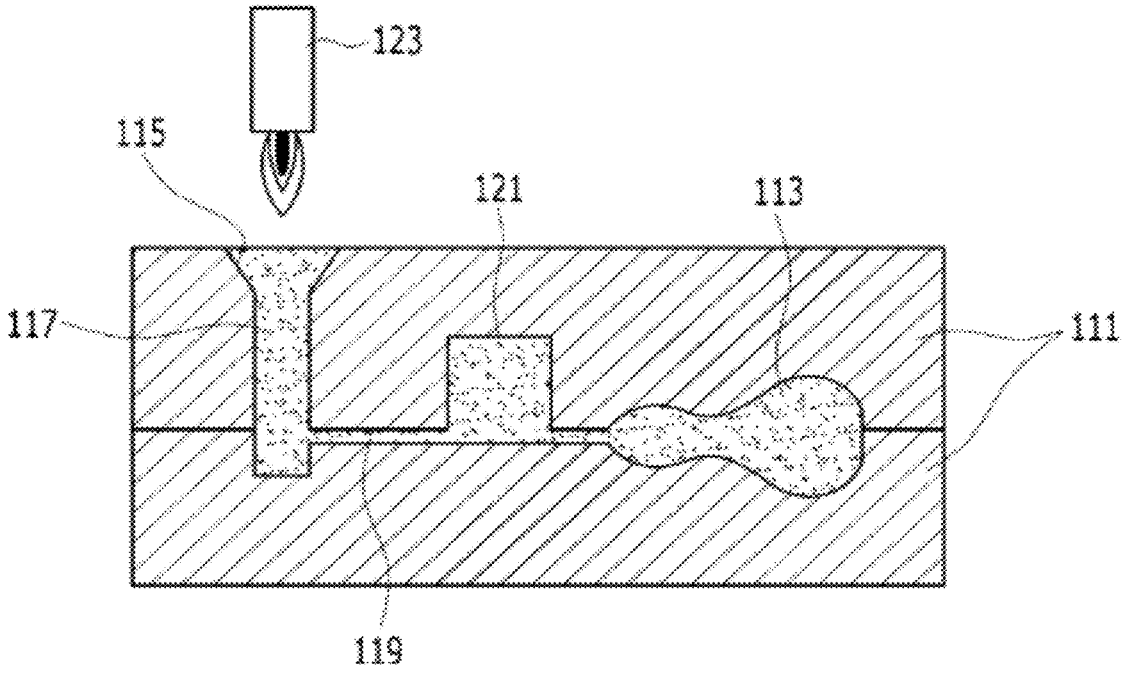
FIG. 1 is a schematic view of a common gravity casting method.
Figure 2:
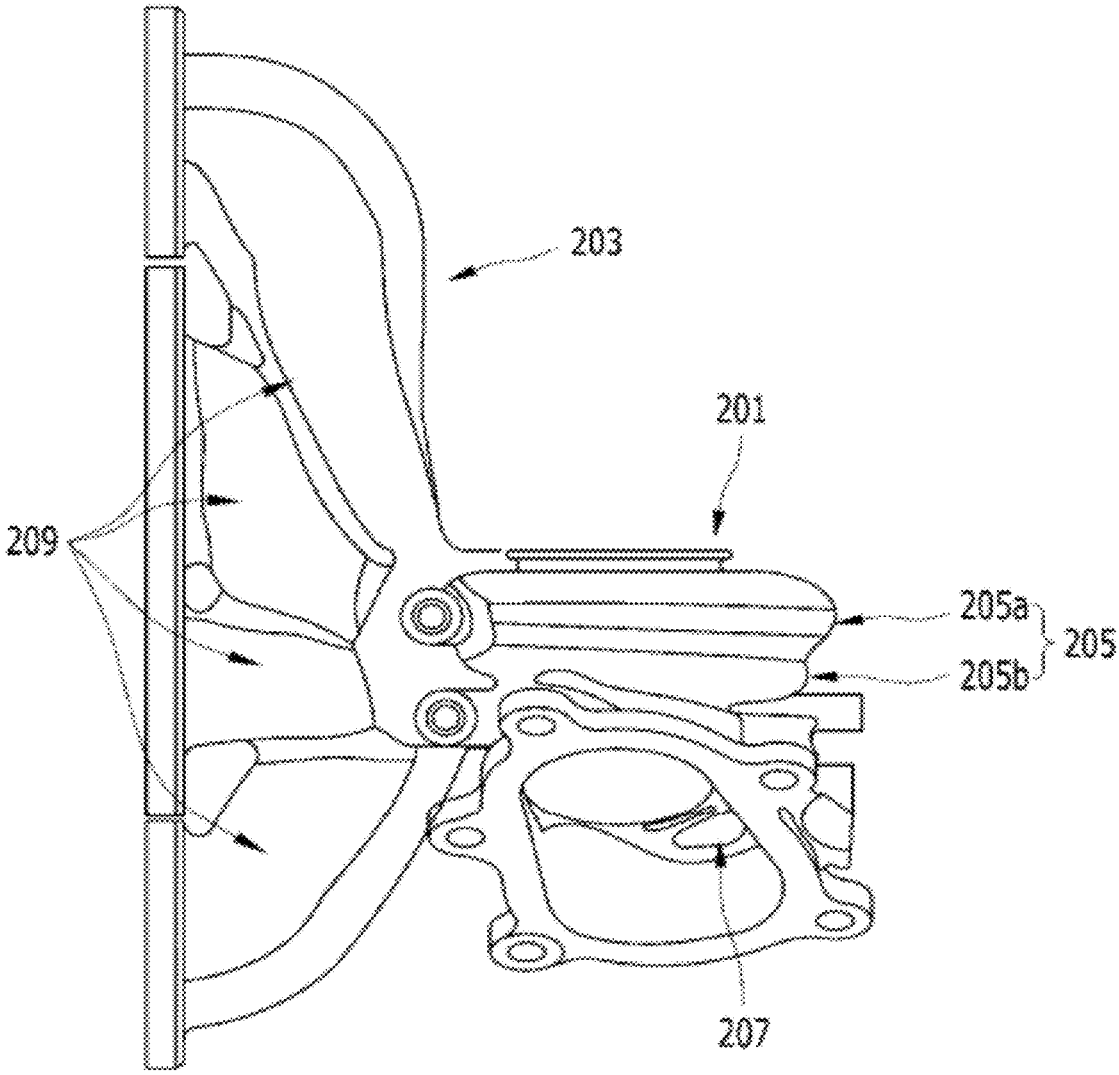
FIG. 2 is a top perspective view of a turbine housing integration type exhaust manifold cast by a gravity casting method.
Figure 3:
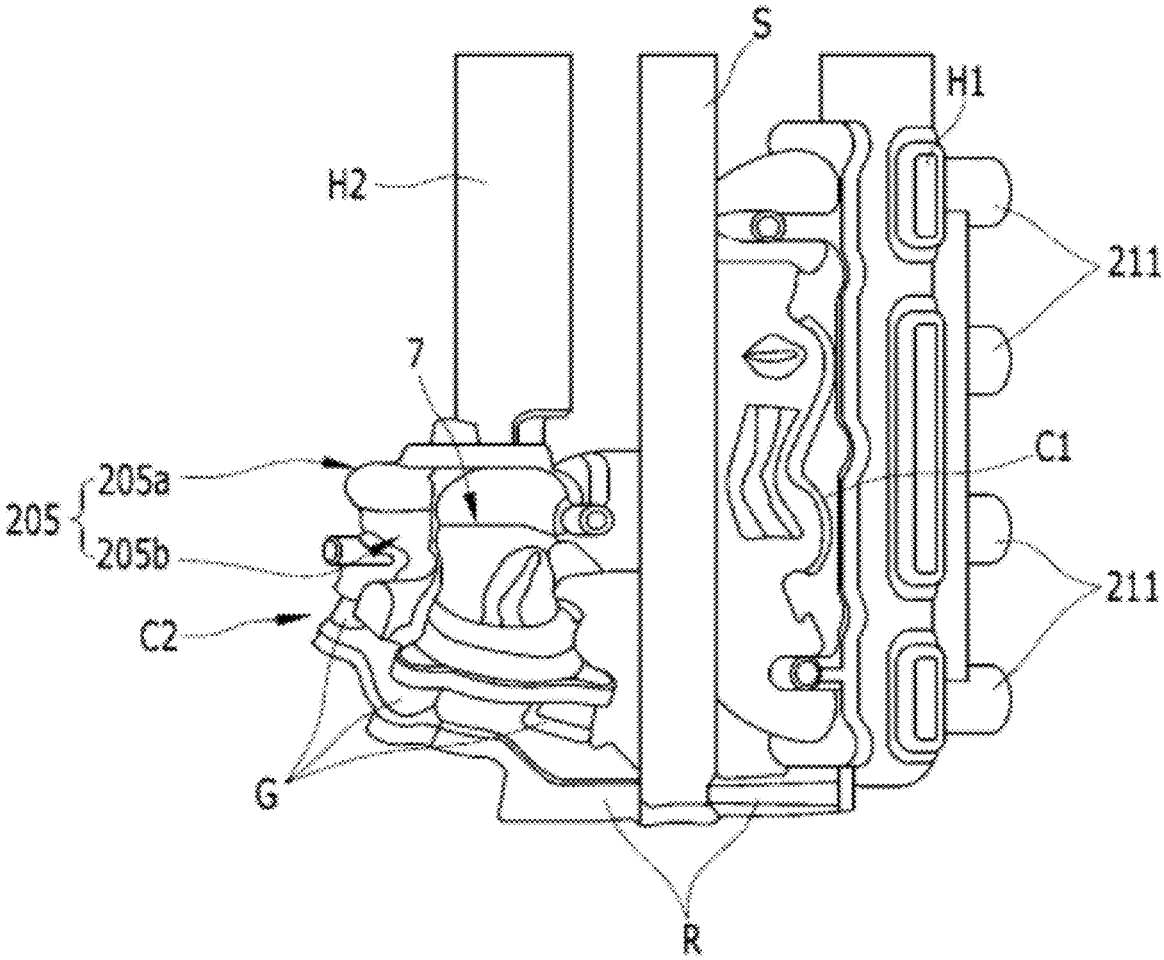
FIG. 3 is an injection schematic view of molten metal according to a conventional gravity casting method.
Figure 4:
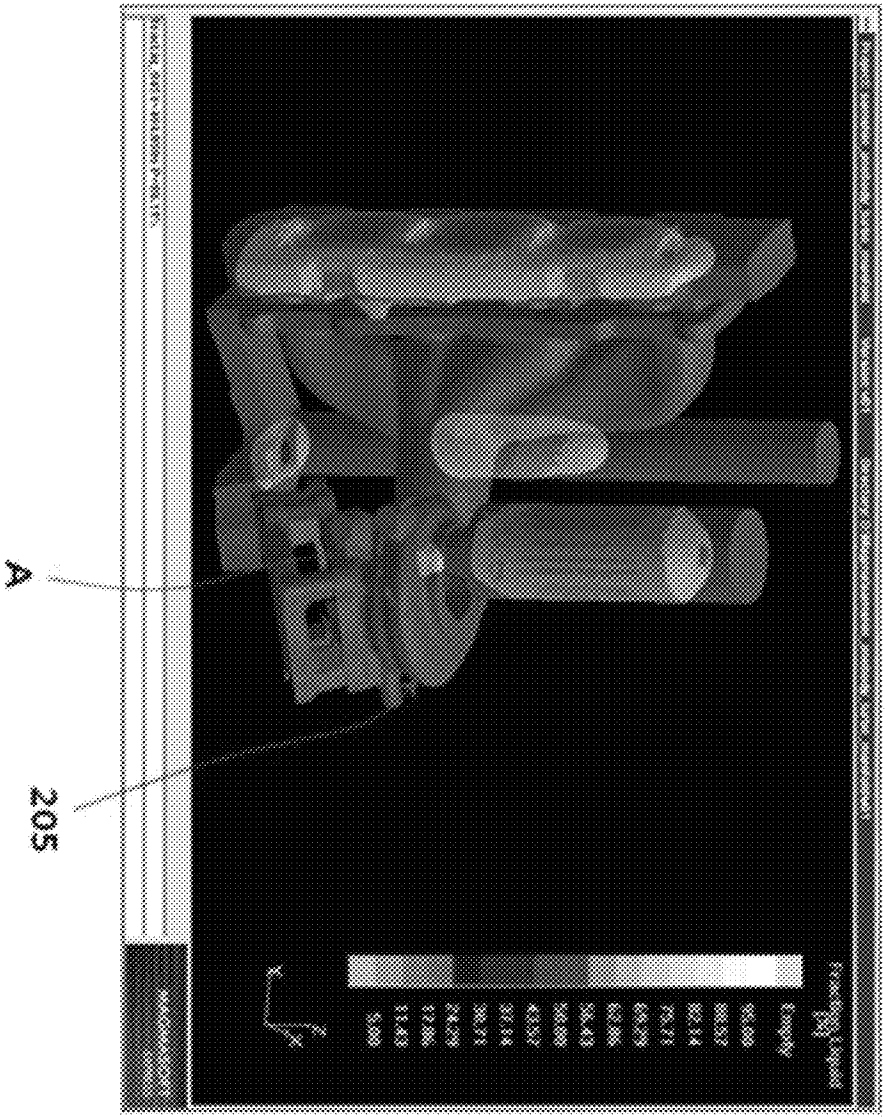
FIG. 4 is a diagram showing a solidification analysis result of molten metal according to the conventional gravity casting method.
Figure 5:
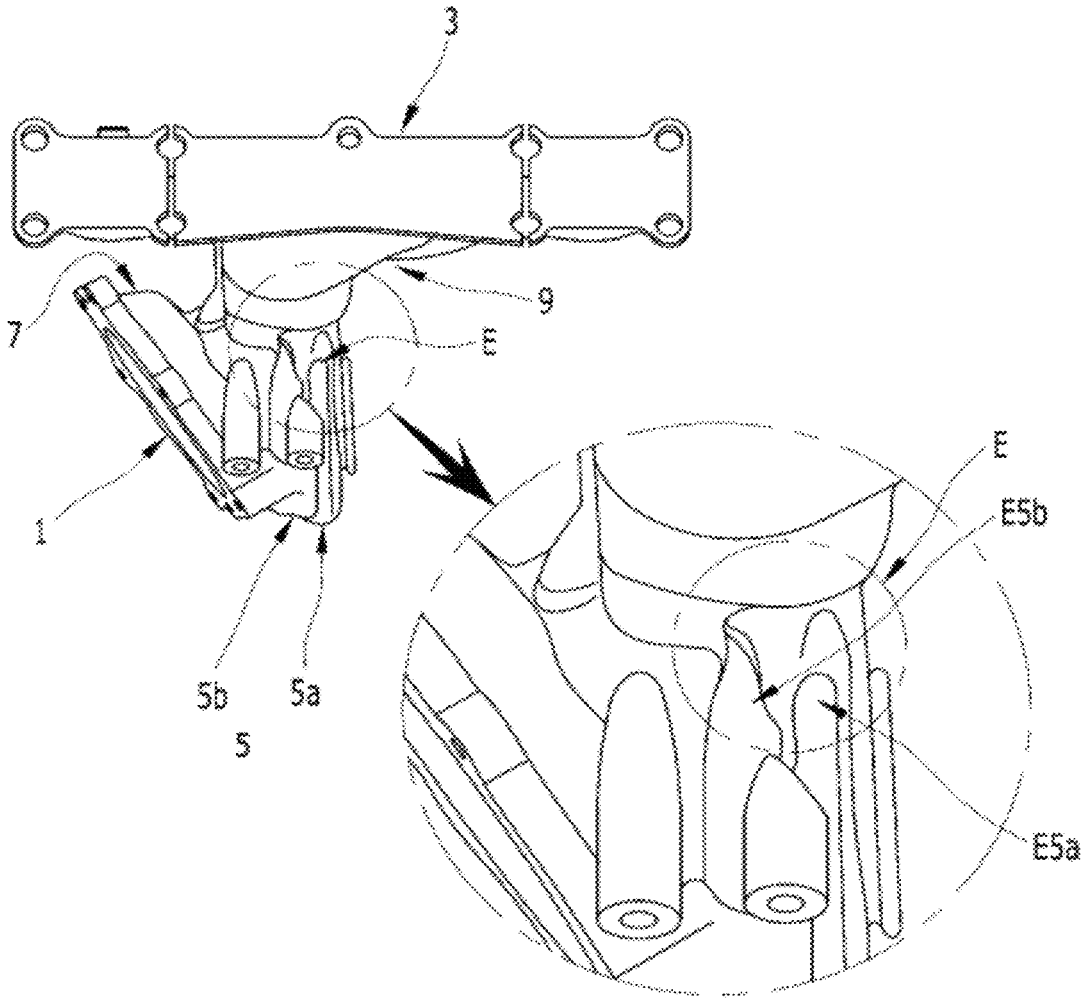
FIG. 5 is a perspective view of an exemplary mold for gravity casting according to the present invention and an exemplary turbine housing integration type exhaust manifold cast by the gravity casting method.

The mold for gravity casting according to various embodiments, as shown in FIG. 5, has an exhaust manifold 3 integrally formed with a turbine housing 1 for a twin scroll turbocharger. Accordingly, one will appreciate that the exhaust manifold and the turbine housing may be monolithically formed. The turbine housing 1 has a twin scroll unit 5 and a bypass unit 7 formed of the internal space portion thereof.

A mold for gravity casting for casting the exhaust manifold 3 having the turbine housing 1 integrated therewith is described below with reference with FIGS. 6 to 8.

Figure 6:
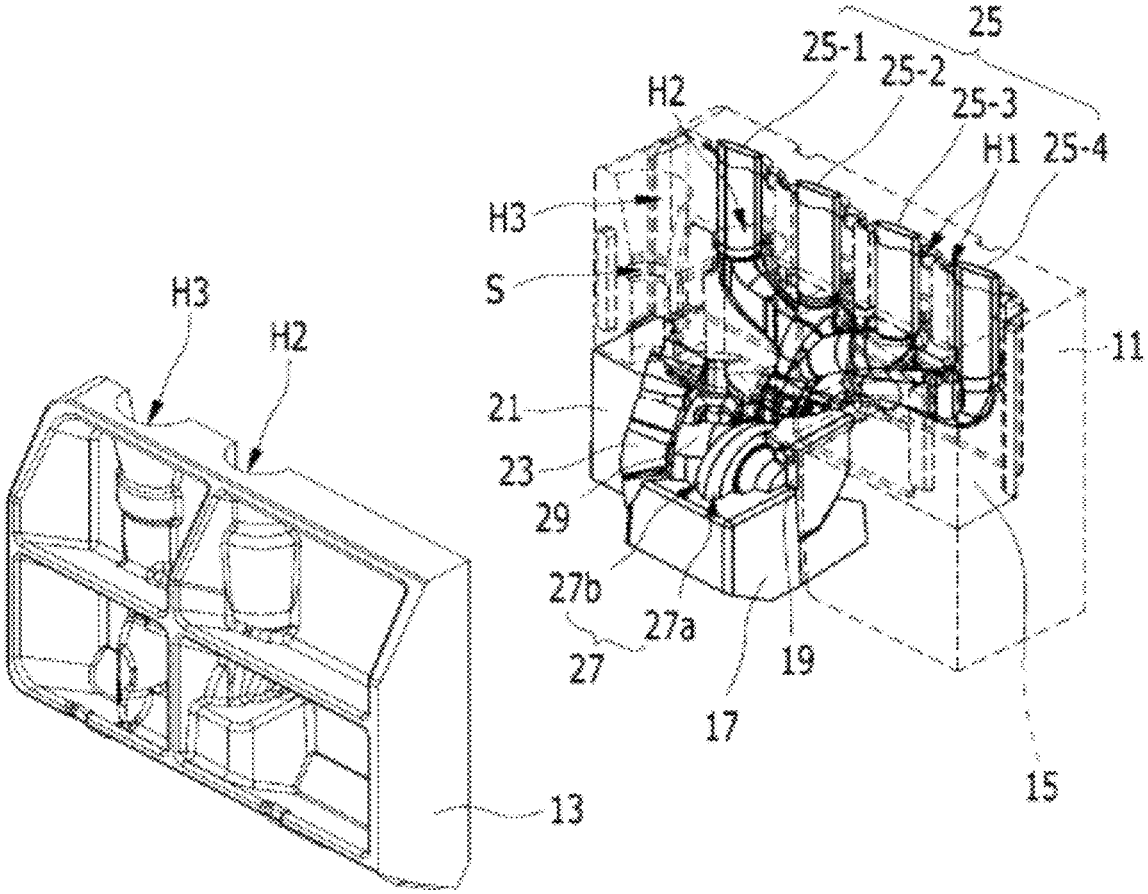
FIG. 6 is a projection perspective view of an exemplary mold for gravity casting according to the present invention.
Figure 7:
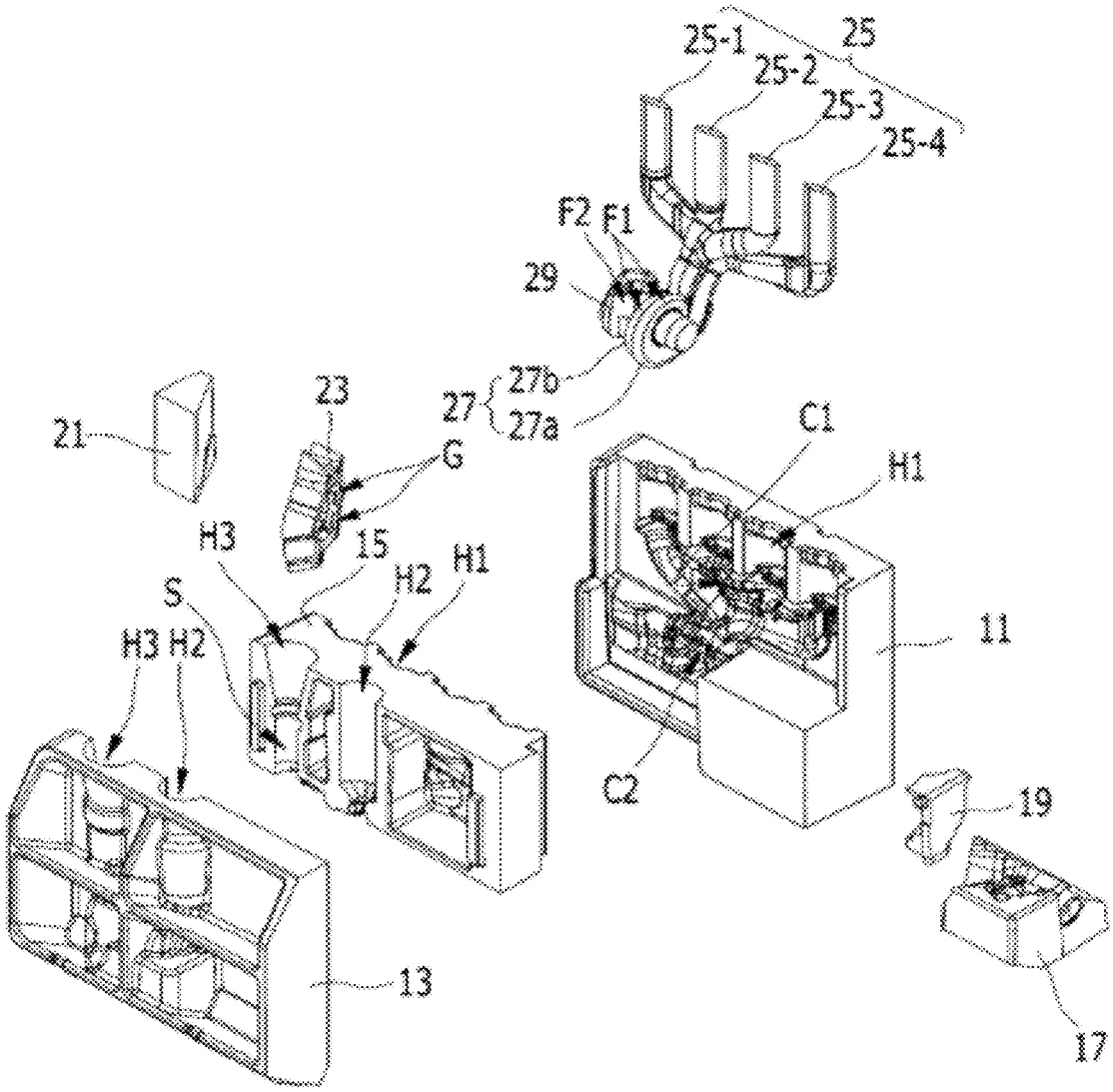
FIGS. 7 and 8 are exploded perspective views of an exemplary mold for gravity casting according to the present invention.
Figure 8:
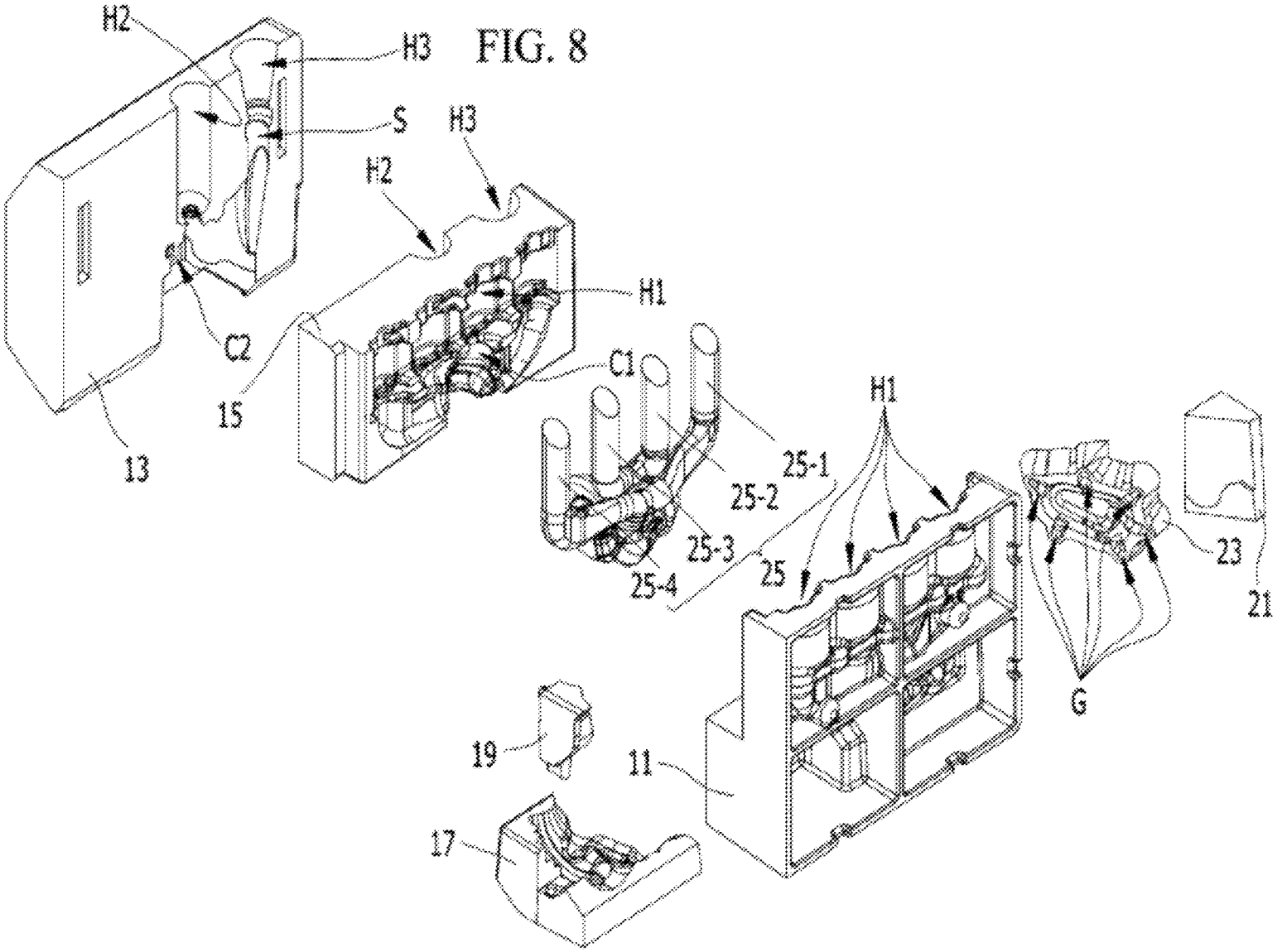

Referring to FIG. 6 to FIG. 8, the mold for gravity casting according to various embodiments basically includes a first mold 11 and a second mold 13. An exhaust runner mold 15 is disposed between the first mold 11 and the second mold 13.

That is, the first mold 11 and the second mold 13 are combined together. The cavity C2 of the turbine housing 1 is formed on the lower inner side of the first mold 11 and the second mold 13 such that the end portion E of the twin scroll unit 5 is upward disposed.

Furthermore, the exhaust runner mold 15 is interposed on the upper side between the first mold 11 and the second mold 13.

The exhaust runner mold 15 forms the cavity C1 of the exhaust manifold 3 connected to the cavity C2 of the turbine housing 1 such that four exhaust runner units 9 are disposed in parallel in a width direction between the exhaust runner mold 15 and the first mold 11.

Furthermore, the exhaust runner mold 15 is formed to connect risers H1 on the exhaust manifold side over the cavity C1 of the exhaust manifold 3 between the exhaust runner mold 15 and the first mold 11.

Furthermore, the exhaust runner mold 15, together with an injection port H3 for injecting molten metal into the cavity C2 of the turbine housing 1, forms a sprue S between the exhaust runner mold 15 and the second mold 13.

Figure 9:
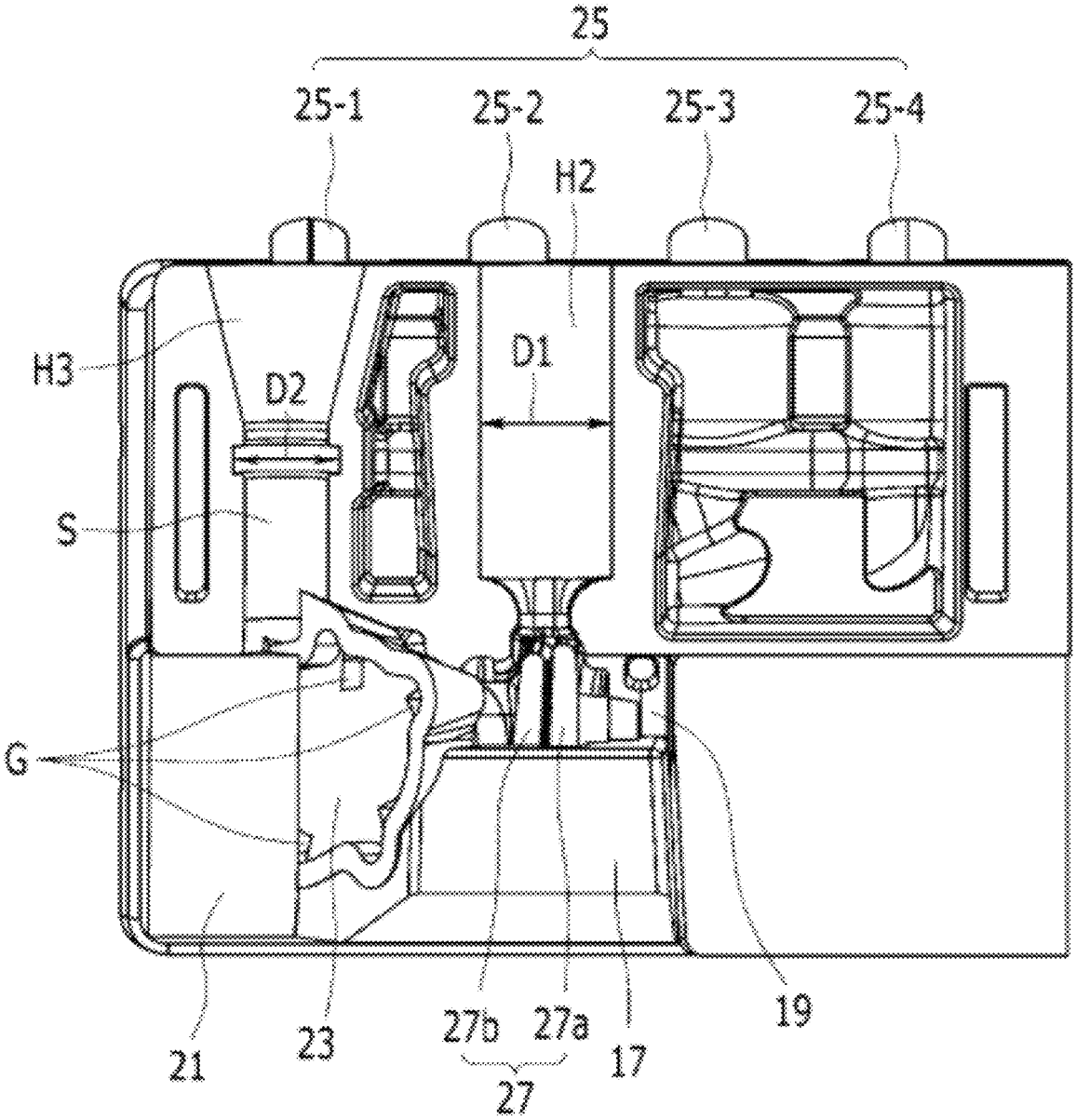
FIG. 9 is a front view showing a state in which a second mold has been removed in an exemplary mold for gravity casting according to the present invention.

Furthermore, the exhaust runner mold 15, as shown in FIG. 9, forms a riser H2 on the turbine housing side based on the end portion E of the twin scroll unit 5 between the exhaust runner mold 15 and the second mold 13.

Here, the turbine housing-side riser H2 is formed to connect both the end portions E5*a* and E5*b* of a scroll unit 5*a* and a scroll unit 5*b* on one side and the other side of the twin scroll unit 5, as shown in FIG. 5.

Meanwhile, a twin scroll mold 17 is formed between the first mold 11 and the second mold 13 so that it forms a lower portion of the cavity C2 of the turbine housing 1.

Furthermore, a twin scroll auxiliary mold 19 is disposed between the first mold 11 and the twin scroll mold 17 and between the exhaust runner mold 15 and the twin scroll mold 17 so that it forms one side of the cavity C2 of the turbine housing 1.

Furthermore, a core support mold 21 is disposed between the first mold 11 and the second mold 13 on the other side of the cavity C2 of the turbine housing 1.

A gate core 23 is disposed in the core support mold 21 between the first mold 11 and the second mold 13 within the mold. Five or six gates G are formed in the gate core 23 and configured to connect the sprue S and the cavity C2 of the turbine housing 1.

Furthermore, an exhaust runner core 25 is disposed within the cavity C1 of the exhaust manifold 3 between the first mold 11 and the exhaust runner mold 15 and is configured to form the exhaust runner units 9 of the exhaust manifold 3.

Furthermore, a twin scroll unit core 27 and a bypass unit core 29 are disposed within the cavity C2 of the turbine housing 1 between the first mold 11 and the second mold 13 and configured to form the twin scroll unit 5 and the bypass unit 7 formed of the internal space portion of the turbine housing 1.

Here, the exhaust runner core 25 may be integrally formed with the twin scroll unit core 27. That is, the exhaust runner core 25 and the twin scroll unit core 27 are formed by integrally connecting exhaust runner cores 25-1 and 25-4, respectively forming the first and the fourth exhaust runner units of the four exhaust runner units 9, and a scroll unit core 27*a* forming the scroll unit 5*a* on one side, from the twin scroll unit 5. Accordingly, one will appreciate that the exhaust runner core and the twin scroll unit core may be monolithically formed. Furthermore, exhaust runner cores 25-2 and 25-3, forming the second and the third exhaust runner units of the four exhaust runner units 9, and a scroll unit core 27*b* forming the scroll unit 5*b* on the other side, from the twin scroll unit 5, are integrally connected and formed. Accordingly, one will appreciate that these cores may also be monolithically formed.

Furthermore, the twin scroll unit core 25 is disposed in the state where coating for preventing a surface adherence phenomenon is applied to faces F1 where the respective scroll units are formed before the twin scroll unit core 25 is installed within the mold. The bypass unit core 29 is installed within the mold in the state where coating is applied to an external formation face F2.

In order to cast the turbine housing integration type exhaust manifold using the mold for gravity casting constructed as above, molten metal of high temperature is injected through the injection port H3 and the sprue S at the top of the combined mold.

Figure 10:
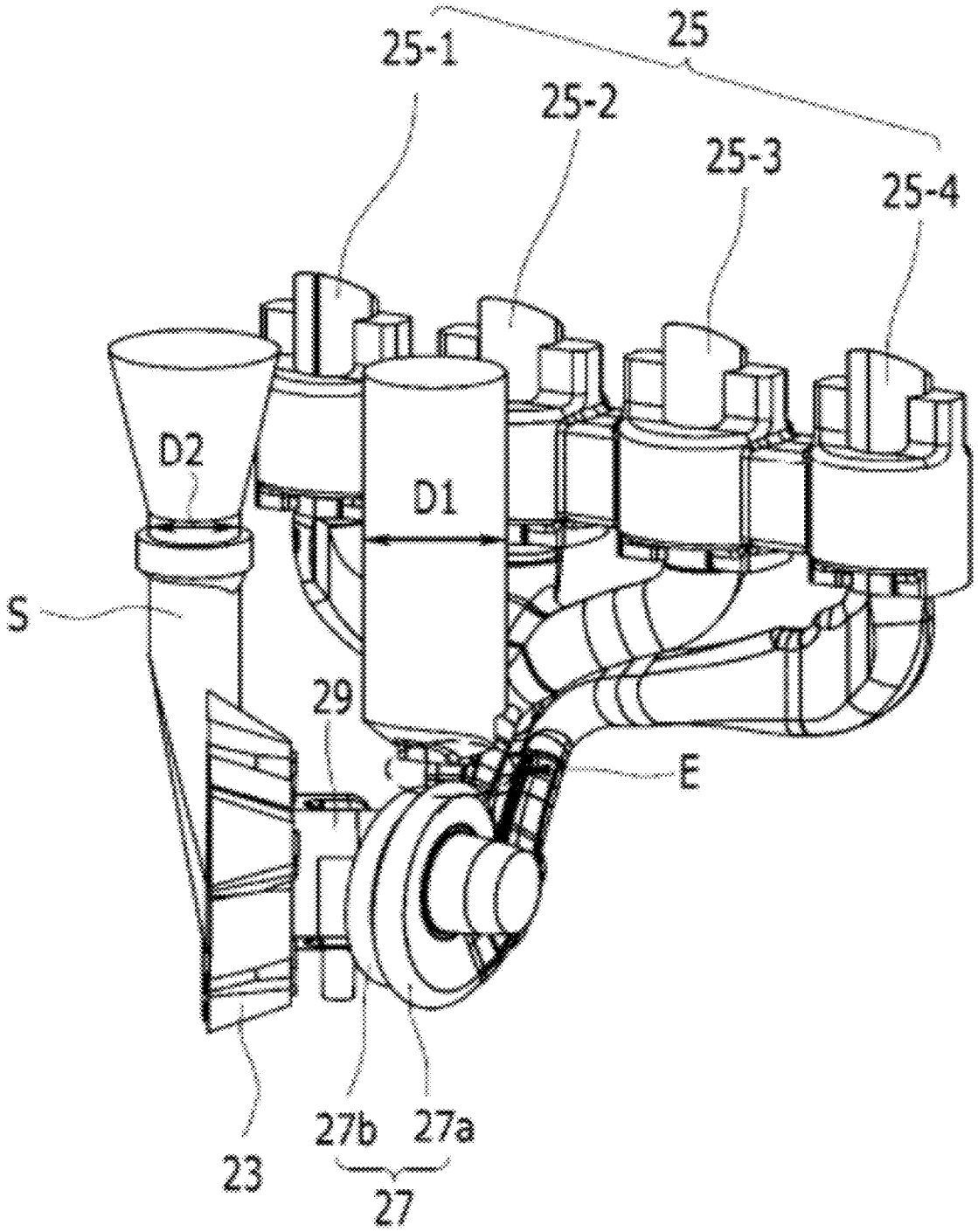
FIG. 10 is an injection schematic view of molten metal according to an exemplary gravity casting method according to an exemplary embodiment of the present invention.

As shown in FIG. 10 (in FIG. 10, the position of the molten metal corresponding to the name of a constituent element is described with reference to the reference numeral of the relevant constituent element), the molten metal is supplied to the gates G of the underlying gate core 23 through the sprue S and then filled into the cavity C2 of the turbine housing 1 and the cavity C1 of the exhaust manifold 3. Next, the molten metal fills the riser H2 on the turbine housing side and the riser H1 on the exhaust manifold side.

At this time, the diameter D1 of the riser H2 on the turbine housing side has to be set in the range of 1.3 to 1.8 times greater than the diameter D2 of the injection port H3 through repeated processes in order to prevent an internal shape from being contracted.

Furthermore, the injection of the molten metal is manually injected. It is appropriate that a molten metal temperature condition by taking a reduction in the molten metal temperature when the molten metal is vertically moved is 1650° C.±20° C.

Here, the molten metal supplied to the cavity C2 of the turbine housing 1 is uniformly filled into the twin scroll unit 5 and the bypass unit 7 within the complicated cavity C2 of the turbine housing 1 through the gates G of the gate core 23 from the sprue S.

In the process of the molten metal being filled into the cavity C2 of the turbine housing 1 forming the twin scroll unit 5, gas generated while the coating applied to prevent a surface adherence phenomenon on the scroll unit formation faces F1 of the twin scroll unit core 27 is immediately exhausted through the riser H2 on the turbine housing side so that the gas is not mixed with the molten metal at the end portion E of the twin scroll unit 5 having a narrow cross section. Accordingly, defects in the surface of a product or the generation of contraction holes can be prevented.

Figure 11:
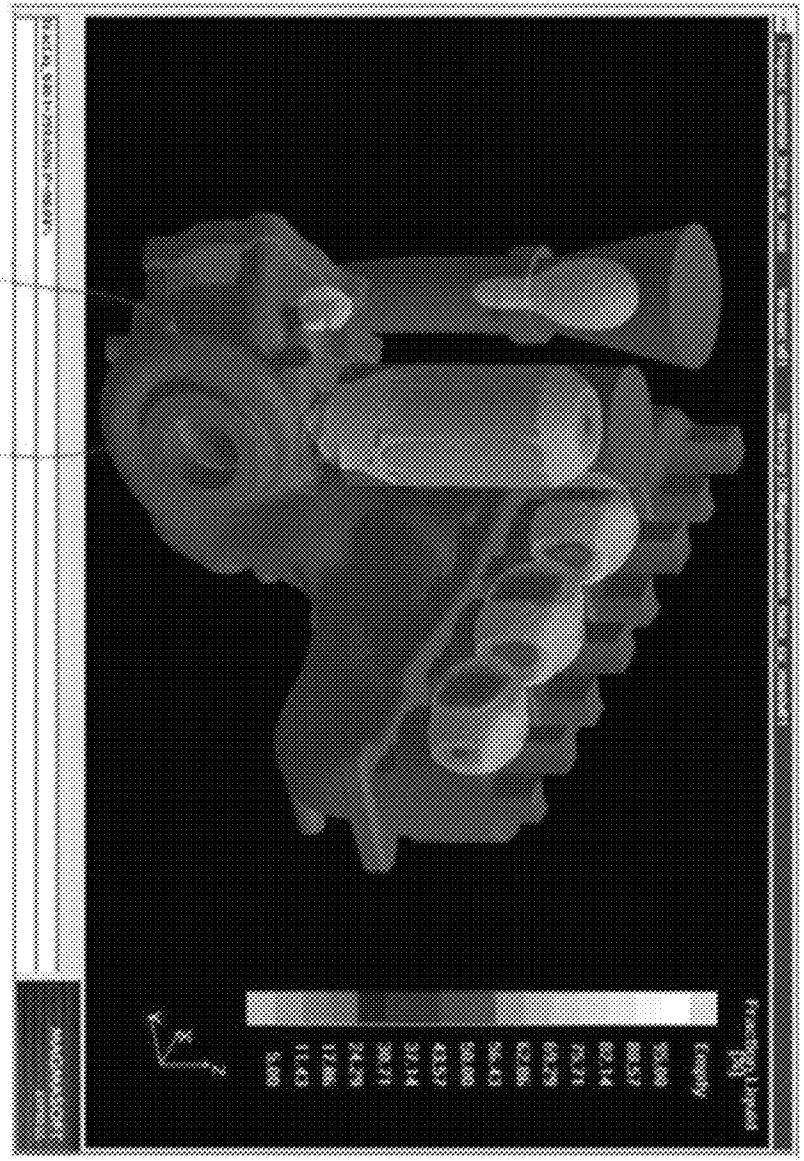
FIG. 11 is a diagram showing a solidification analysis result of molten metal according to an exemplary gravity casting method according to the present invention.

That is, as can be seen from a solidification analysis result of FIG. 11, residual stress is not generated near the end portion E of the twin scroll unit 5 having a narrow cross section, and thus product defects, such as conventional contraction holes, can be prevented.

Meanwhile, the surface adherence phenomenon is prevented by the coating coated on the twin scroll unit core 27 and the bypass unit core 29.

As described above, in the state where both the cavity C2 of the turbine housing 1 and the cavity C1 of the exhaust manifold 3 are filled with the molten metal within the mold, when the molten metal is contracted in a cooling process, the molten metal filled into the riser H2 on the turbine housing side and the riser H1 on the exhaust manifold side are supplied to supplement the contraction amount of the molten metal.

For convenience in explanation and accurate definition in the appended claims, the terms upper or lower, front, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A mold for gravity casting for integrally gravity casting a turbine housing having a twin scroll unit and a bypass unit and an exhaust manifold having a plurality of exhaust runner units, the mold comprising:

a first mold;

a second mold combined with the first mold configured to form a cavity of the turbine housing so that an end portion of the twin scroll unit is upward disposed on a lower inner side between the first mold and the second mold;

an exhaust runner mold disposed on an upper side between the first mold and the second mold, configured to form a cavity of the exhaust manifold connected to the cavity of the turbine housing so that the exhaust runner units are disposed in parallel in a width direction between the first mold and the exhaust runner mold and also to connect to an exhaust manifold-side riser over the cavity of the exhaust manifold, and configured to form a sprue along with an injection port for injecting molten metal into the cavity of the turbine housing between the second mold and the exhaust runner mold and also to form a turbine housing-side riser based on the end portion of the twin scroll unit;

a twin scroll mold installed between the first mold and the second mold so that the twin scroll mold forms a lower portion of the cavity of the turbine housing;

a twin scroll auxiliary mold installed between the first mold and the twin scroll mold and between the exhaust runner mold and the twin scroll mold so that the twin scroll auxiliary mold forms one side of the cavity of the turbine housing;

a core support mold installed between the first mold and the second mold on the other side of the cavity of the turbine housing;

a gate core disposed in the core support mold between the first mold and the second mold and configured to form a plurality of gates connecting the sprue and the cavity of the turbine housing;

exhaust runner cores disposed within the cavity of the exhaust manifold between the first mold and the exhaust runner mold and configured to form the exhaust runner units of the exhaust manifold; and a twin scroll unit core and a bypass unit core disposed within the cavity of the turbine housing between the first mold and the second mold and configured to form the twin scroll unit and the bypass unit, respectively, formed of an internal space portion of the turbine housing.

2. The mold of claim 1, wherein the turbine housing-side riser is formed to simultaneously connect end portions of scroll units of the twin scroll unit.

3. The mold of claim 1, wherein a diameter of the turbine housing-side riser is set in a range of 1.3 to 1.8 times greater than a diameter of the injection port.

4. The mold of claim 1, wherein the exhaust runner cores are integrally formed with the twin scroll unit core.

5. The mold of claim 4, wherein the exhaust runner cores and the twin scroll unit core are formed by integrally connecting the two exhaust runner cores, respectively forming first and fourth of the four exhaust runner units, and a scroll unit core forming the scroll unit on one side, from the twin scroll unit and by integrally connecting the two exhaust runner cores, respectively forming second and third of the four exhaust runner units, and a scroll unit core forming the scroll unit on the other side, from the twin scroll unit.

* * * * *